US005348077A

United States Patent [19]

Hillman

[11] Patent Number: 5,348,077

[45] Date of Patent: Sep. 20, 1994

[54] INTEGRATED AIR EXCHANGER

[76] Inventor: Chris F. Hillman, 1422 Madrona Point Dr., Bremerton, Wash. 98312

[21] Appl. No.: 677,396

[22] Filed: Mar. 29, 1991

[51] Int. Cl.[5] ..... F25B 29/00

[52] U.S. Cl. ..... 165/16; 165/48.1; 165/59; 62/325

[58] Field of Search ..... 62/325; 137/597, 875, 137/876, 625.43; 165/97, 48.1, 16, 59; 237/46

[56] References Cited

U.S. PATENT DOCUMENTS

| | | | |
|---|---|---|---|
| 2,391,151 | 12/1945 | Gibson | 62/325 |
| 2,401,560 | 6/1946 | Graham et al. | 62/325 |
| 2,466,383 | 4/1949 | Cody | 62/325 |
| 2,718,119 | 9/1955 | Prince | 62/325 |
| 2,755,072 | 7/1956 | Kreuttner | 62/325 |
| 2,969,652 | 1/1961 | Blanchard | 62/325 |
| 2,984,087 | 5/1961 | Folsom | 62/325 |
| 3,143,864 | 11/1964 | Schordine | 62/325 |
| 3,995,446 | 12/1976 | Eubank | 62/325 |
| 4,477,020 | 10/1984 | Makara | 237/46 |
| 4,491,061 | 1/1985 | Nishizawa et al. | 165/16 |
| 4,517,810 | 5/1985 | Foley et al. | 165/16 |
| 4,566,531 | 1/1986 | Stolz | 62/325 |
| 4,678,025 | 7/1987 | Oberlander | 62/325 |
| 4,841,733 | 6/1989 | Dussault et al. | 165/16 |
| 4,918,933 | 4/1990 | Dyer | 62/238.6 |
| 5,024,263 | 6/1991 | Laine et al. | 165/16 |

FOREIGN PATENT DOCUMENTS

| | | | |
|---|---|---|---|
| 3602120 | 8/1987 | Fed. Rep. of Germany | 237/46 |
| 0110841 | 8/1980 | Japan | 62/325 |
| 0178913 | 11/1982 | Japan | 62/325 |
| 0184843 | 11/1982 | Japan | 62/325 |

*Primary Examiner*—John K. Ford

*Attorney, Agent, or Firm*—Christensen, O'Connor, Johnson & Kindness

[57] ABSTRACT

An integrated air exchanger (10) is disclosed for controlling the volume and temperature of air exchanged between an external environment (14) and a supplied environment (16). In that regard, a relatively simple crossed damper (72) controls air introduced to the air exchanger along an external air path (18) and return air path (20) to be returned to the supplied environment in an external environment through a supply air path (24) and exhaust air path (22) in a controlled relationship. A supply coil (56) is included to effect heat transfer to the air provided to the supplied environment. A system controller (70) controls a heat source (60), compressor (62), valves (64 and 66) and the damper to achieve the desired temperature and air direction. Exchangers (134 and 178) are also disclosed for use in satisfying the heating, ventilation, and cooling demands of a plurality of different environments.

7 Claims, 12 Drawing Sheets

INTEGRATED AIR EXCHANGER

FIELD OF THE INVENTION

This invention relates generally to air exchangers and, more particularly, to integrated air exchangers.

BACKGROUND OF THE INVENTION

Modern residential, commercial, and industrial buildings generally include systems for exchanging air between the inside and outside of the building, as well as between different sections of the building. In that regard, virtually all air exchanger systems provide fresh or recirculated air to the building. The volume and source of the exchanged air can be controlled to achieve the desired ventilation.

An air exchange system may also be designed to control the ingress and egress of gases, vapors, and particulate with respect to a ventilated space. For example, by introducing more air than it draws from a room, an air exchange system increases the pressure of the air in the room above that of the surrounding atmosphere. As a result, air will flow out of the room through any openings that might otherwise allow undesired gases and particulate to enter. By withdrawing more air from the room than is introduced, the air exchange system has the opposite effect.

Most air exchange systems also include some provision for controlling the temperature of the exchanged air. The desired temperature of the area being serviced is usually a function of the manner in which the area is used. To achieve the desired temperature, the exchange system may need to heat or cool the air supplied to the area, depending upon the initial temperature of the area and the source of the air used.

Conventional heating, ventilation, and cooling (HVAC) air exchange systems employ separate, and often independent, components or subsystems to achieve these functions. Addressing each of these components in greater detail, a basic ventilation system will be considered first. Such a ventilation system includes a blower, control circuit, filter, and housing.

The blower is regulated by the control circuit and is responsible for establishing airflow between the system and the ventilated room. In that regard, an air inlet and air outlet are provided between the ventilation system and the ventilated room. The blower may be located at the air inlet to force air into the room, with air escaping from the room through the air outlet. Alternatively, the blower may be located at the air outlet to draw air out of the room, with fresh air entering the room through the air inlet.

A somewhat more complex ventilation system includes two blowers. Specifically, a supply blower is provided adjacent the air inlet and a return blower is located adjacent the air outlet. With two blowers employed, the load on each blower is less than would be experienced by a single blower. In addition, the use of separate inlet and outlet blowers allows the control circuit to easily regulate the relative rates of air supply and return to achieve underpressure or over-pressure ventilation.

Turning now to a discussion of the heating systems employed in air exchange systems, such systems commonly employ a heat source, heat transfer system, blower, and control circuit. The heat source converts energy from, for example, gas or electricity into thermal energy. The transfer system usually forms a closed loop that couples the heat source and the airflow path.

In that regard, the transfer system may include a transfer coil, positioned in the airflow path and coupled to the heat source by a pair of conduits. A pump circulates fluid heated by the heat source to the coil, where the fluid's heat is transferred to the air. The coil preferably has a relatively large surface area, allowing it to efficiently transfer heat from the fluid to the air.

The heating system blower is responsible for circulating air between the room to be heated and the transfer coil. In that regard, the blower draws air from the room through an air inlet and forces it across the transfer coil. The heated air is then returned to the room through an air outlet.

The control circuit of the heating system allows the temperature of the air in the room to be regulated. The control circuit typically includes an input control that generates an input signal indicative of a desired room temperature selected by an operator. A temperature sensor similarly generates an input signal indicative of the room's actual temperature. The control circuit regulates the operation of the heat source and blower, based upon the feedback obtained from the input signals, to produce the desired room temperature.

Some heating systems exhaust air to the environment, rather than recirculating it to the room being heated. In such systems, an effort is often made to recover heat from the air before it is exhausted. Heat recovery usually involves the addition of a second heat transfer coil to the closed loop of the heating system. The second coil is coupled between the first coil and the heat source and is positioned in the path of the air being drawn from the room. As a result, the air's thermal energy is transferred to the second coil rather than to the environment. Fluid circulation between the second coil and first coil then allows this energy to be transferred to the air entering the room, avoiding energy loss that would otherwise occur.

The third component of an air exchange system to be discussed is the cooling system. In that regard, a conventional cooling system typically includes an evaporator, compressor, condenser, expansion valve, supply blower, exhaust blower, and control circuit.

Reviewing the operation of these elements, the evaporator is a coiled tube containing a refrigerant at a relatively low pressure. As the pressure of the refrigerant is lowered, the refrigerant evaporates, cooling the evaporator. The compressor then pumps the vaporized refrigerant from the evaporator to the condenser.

At the condenser, which is also a coiled tube, the pressure of the refrigerant is increased. When a sufficiently high pressure is reached, the refrigerant condenses back into liquid form, transferring heat to the condenser. The liquid refrigerant Is then returned to the evaporator through the expansion valve at the desired low pressure.

This evaporation/condensation cycle is used to cool the air supplied to the room in the following manner. The evaporator is positioned in the airflow path, for example, adjacent the air supply outlet. The supply blower draws air from the room through an air inlet and forces it over the evaporator's coils before returning it to the room through a supply outlet. As a result, the air supplied to the room is cooled.

The condenser, on the other hand, is not positioned in the path of the air supplied to the room. Rather, the condenser is located adjacent an air exhaust outlet, which opens to the outside environment. Air is drawn from the air inlet by the exhaust blower and forced across the condenser to remove heat from the condenser. The warm air is then passed to the environment through the exhaust outlet.

Like the control circuit of a heating system, the cooling system control circuit allows the temperature of the air in the room to be regulated. The control circuit typically includes an input control that generates an input signal indicative of a desired room temperature selected by an operator. A temperature sensor similarly generates an input signal indicative of the room's actual temperature. The control circuit regulates the operation of the evaporation/condensation cycle and the blowers, based upon feedback obtained from the input signals, to produce the desired room temperature.

As noted previously, the separate ventilation, heating, and cooling components of an air exchange system are often independently controlled to achieve the desired air circulation and temperature. More sophisticated exchange systems have been developed, however, employing a common control circuit to interactively regulate the operation of the otherwise physically independent components and achieve the desired ventilation and room temperature more efficiently.

For example, an integrated control circuit may include a master operator control that generates an input signal representative of the desired ventilation and temperature to be maintained in a room. A set of sensors may also be included to produce signals indicative of, for example, the actual room temperature and the ambient temperature of the external environment. The control circuit responds to these input signals by cooperatively regulating the operation of the ventilation, heating, and cooling systems to achieve the desired ventilation and room temperature. For example, depending upon the relationship between the room temperature and ambient temperature, the control circuit may be able to raise or lower the room's temperature to a desired level using ventilation alone.

As noted previously, although the air exchange systems discussed above perform heating, ventilation, and cooling, they typically employ discrete subsystems that are independently designed, installed, and maintained. At best, these subsystems are commonly controlled or integrate the functions of heating and ventilation or cooling and ventilation. As a result, conventional HVAC air exchange systems tend to be conglomerations of components that are expensive, complex, and difficult to service and adapt.

Another shortcoming of existing air exchange systems relates to their use in providing heat, ventilation, and air conditioning to a number of areas. In that regard, the problem of multiple-site service is commonly addressed by providing a separate air exchange system for each of the areas to be covered. As will be appreciated, while this technique allows the heating, ventilation, and cooling of each area to be independently controlled, the installation of separate systems can be complicated, time consuming, and quite expensive.

An alternative solution to this multiple-site problem involves the use of a conventional single-site air exchange system, provided with separate ducts to and from each of the areas to be serviced. This approach is less cumbersome and expensive than the redundant system configuration described above. However, a conventional single-site air exchanger offers limited control over the service supplied to the different areas and often lacks sufficient capacity to adequately handle the collective needs of the various sites.

In view of these observations, it would be desirable to provide an air exchanger that efficiently performs heating, ventilation, and cooling in a single, easily installed, serviced, and maintained unit. In addition, it would be desirable to provide a unit that can be quickly, easily, and efficiently modified for use in satisfying the heating, ventilation, and cooling needs of a number of different sites.

SUMMARY OF THE INVENTION

An integrated air exchanger is disclosed for providing, in a single unit, each of the desired functions of heating, ventilation, cooling, and energy recovery. The exchanger includes a damper that simply and efficiently allows the desired air transfer to occur in the exchanger.

In accordance with this invention, the air exchanger is for controlling the flow of air between a supplied environment and an external environment. The air exchanger includes a housing for defining an air exchange chamber, an external air path and exhaust air path between the air exchange chamber and the external environment, and a return air path and supply air path between the air exchange chamber and the supplied environment. The exchanger also includes a supply energy transfer system, at least partially positioned in the supply air path, for influencing the temperature of air flowing through the supply air path to the supplied environment. An exhaust energy transfer system, at least partially positioned in the exhaust air path, Is included to influence the temperature of air flowing through the exhaust air path to the external environment. A supply air blower is included to induce airflow through the supply air path and an exhaust air blower is included to induce airflow through the exhaust air path.

An airflow control damper is positioned in the air exchange chamber, and has first, second, third, and fourth arms extending from a central axis. The first and second arms cooperatively control the flow of air from the return air path and the external air path to the supply air path. The third and fourth arms cooperatively control the flow of air from the return air path and the external air path to the exhaust air path. The exchanger also includes a damper control for controlling the operation of the first, second, third, and fourth damper arms.

In accordance with another aspect of the invention, the damper is included to direct airflow between supply, external, exhaust, and return air paths. The damper includes a return/supply airflow control device for controlling the flow of air from the return air path to the supply air path. A supply/external airflow control device controls the flow of air from the external air path to the supply air path. An external/exhaust airflow control device controls the flow of air from the external air path to the exhaust air path. Finally, an exhaust-/return airflow control device controls the flow of air from the return air path to the exhaust air path.

BRIEF DESCRIPTION OF THE DRAWINGS

The invention will presently be described in greater detail, by way of example, with reference to the accompanying drawings, wherein.

DETAILED DESCRIPTION OF THE PREFERRED EMBODIMENT

Figure 1:
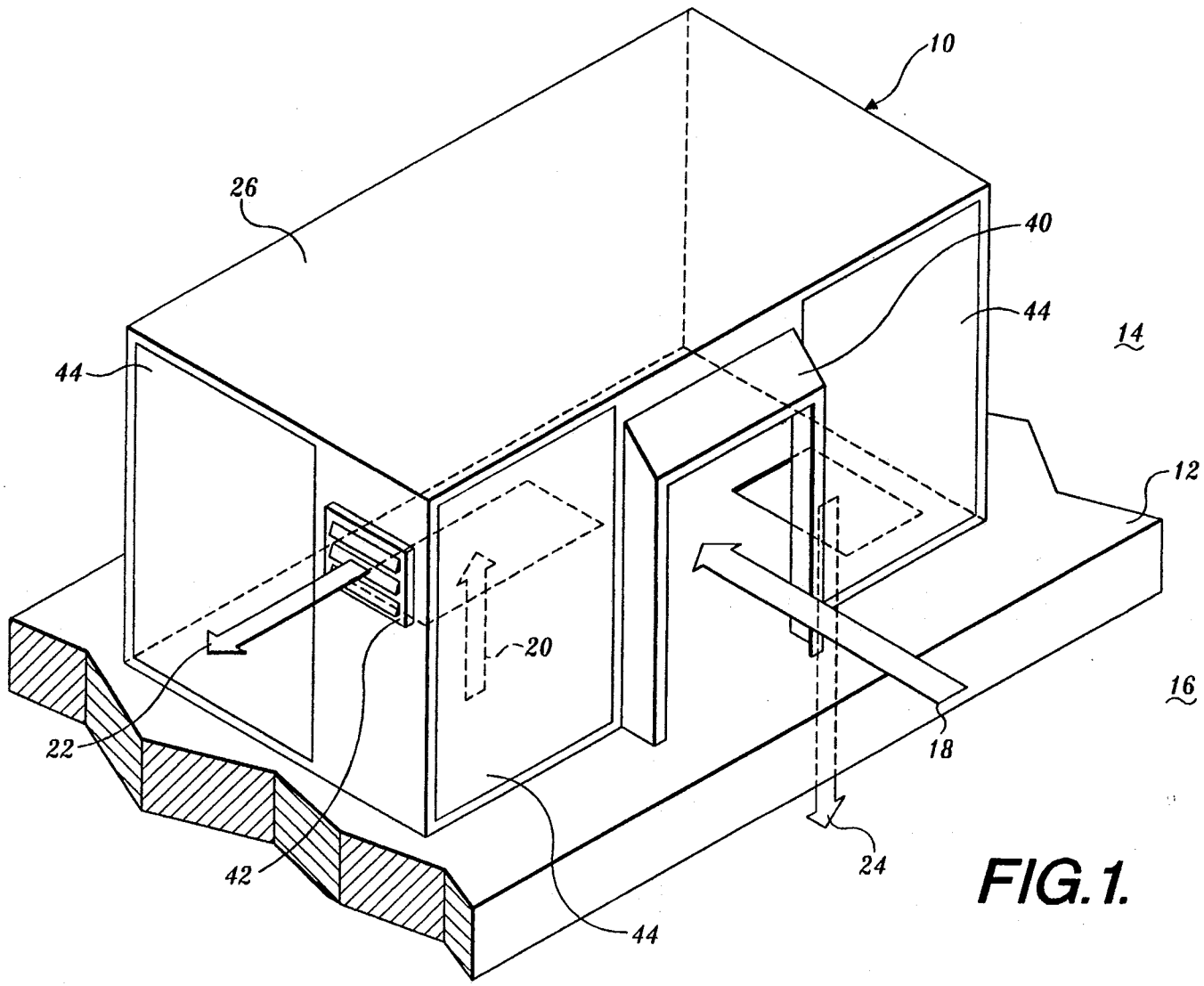
FIG. 1 is an illustration of an integrated air exchanger constructed in accordance with this invention.

Referring now to FIG. 1, an integrated air exchanger 10 constructed in accordance with the invention is shown. Exchanger 10 is positioned, for example, on the roof 12 of a building and controls the transfer of air between the external environment 14 of the building and the supplied environment 16 inside the building. More particularly, the exchanger 10 draws air from the external environment 14 through an external air path 18 and air from the supplied environment 16 through a return air path 20. The air exchanger 10 also returns air to the external environment 14 through an exhaust air path 22 and to the supplied environment 16 through a supply air path 24.

As will be described in greater detail below, the components of the air exchanger 10 cooperatively provide the desired ventilation for the supplied environment 16, as well as ensure that the air introduced is at the desired temperature. The integrated nature of the exchanger 10 allows for efficient operation, easy adaptability, and ease of installation, maintenance, and service.

Reviewing the various components of air exchanger 10 in greater detail, the exchanger 10 includes a housing 26. The housing 26 provides the structure that supports the other components and integrates them into a single unit. In addition, housing 26 partially defines the various paths 18, 20, 22, and 24 for air exchange. Finally, housing 26 protects the various components of exchanger 10, while allowing them to be easily accessed for service.

Figure 2:
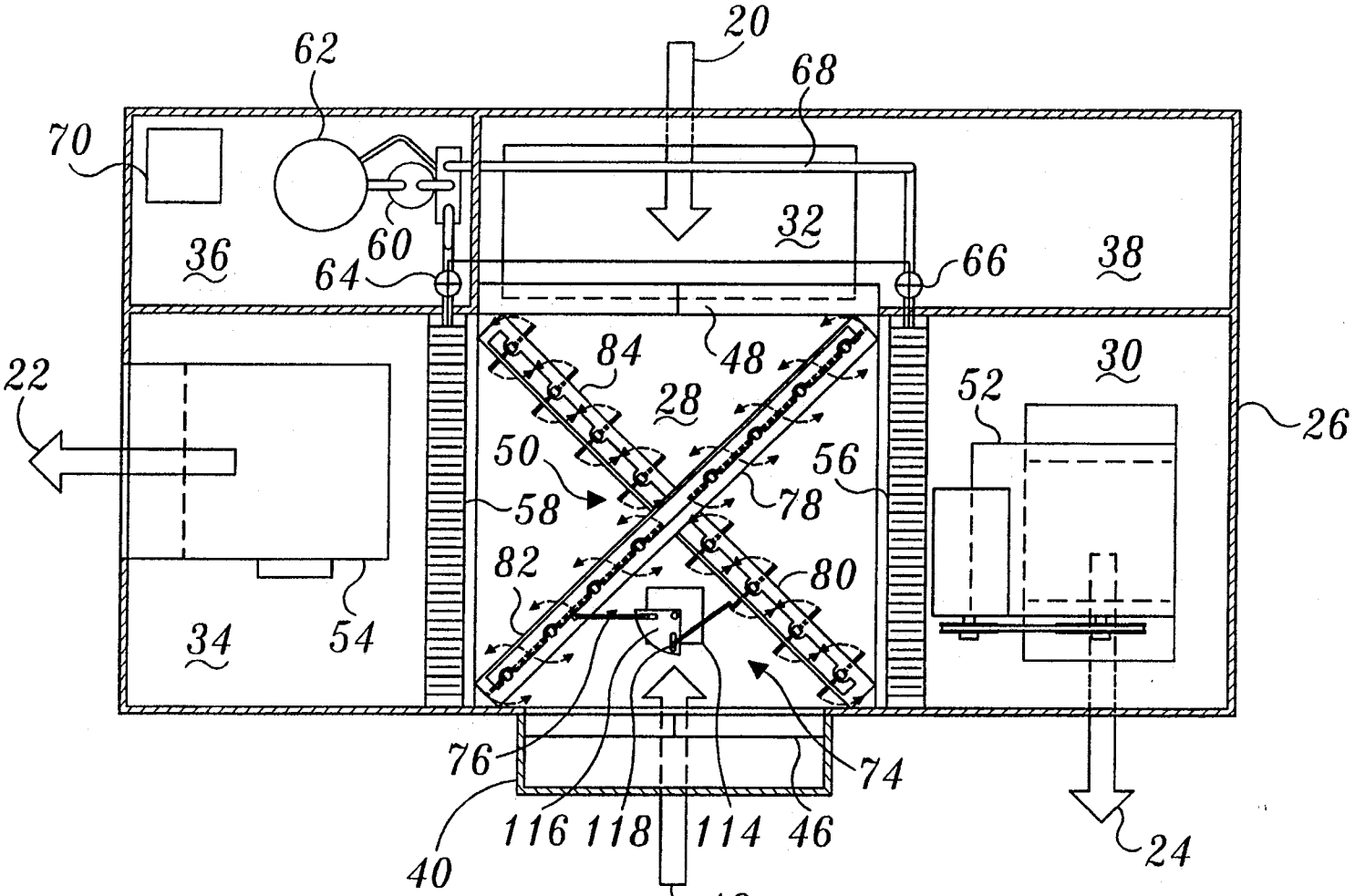
FIG. 2 is a schematic illustration of the integrated air exchanger of FIG. 1.

As shown in FIG. 2, the housing 26 is basically divided into six chambers. An air exchange chamber 28 links each of the air paths 18, 20, 22, and 24. An air supply chamber 30, air return chamber 32, and air exhaust chamber 34 each partially define the supply air path 24, return air path 20, and exhaust air path 22, respectively. The housing 26 also includes first and second control chambers 36 and 38.

A rain hood 40 is included with housing 26 to shield the entry of air into the air exchange chamber 28 along the external air path 18. A back-draft damper 42, provided adjacent the air exhaust chamber 34, essentially acts as a one-way valve in the exhaust air path 22, preventing air from flowing back into housing 26 along the exhaust air path 22. Housing 26 also includes six service access doors 44 to allow access to the various chambers and components of exchanger 10.

Figure 3:
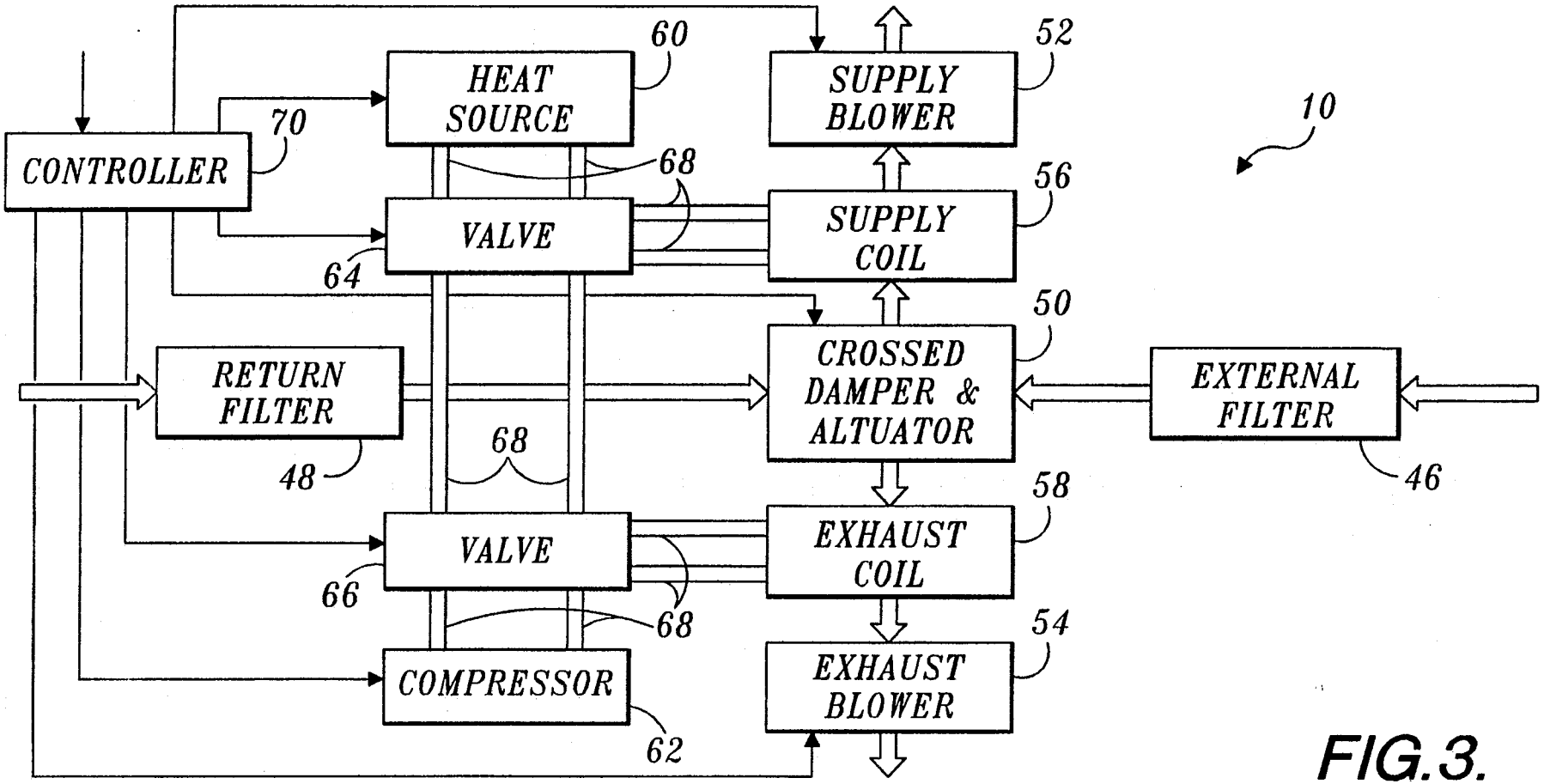
FIG. 3 is a block diagram of the air exchanger of FIG. 1.

Turning now to the various internal components of the air exchanger 10, reference is additionally had to FIG. 3. As shown, the exchanger 10 includes a first set of components that filter and direct the flow of air through exchanger 10. These components include an external filter 46 and return filter 48 for removing particulate and other foreign matter from air input to the exchanger 10. A crossed or X-shaped damper and actuator assembly 50 directs the flow of air from filters 46 and 48 to either a supply blower 52 or exhaust blower 54, which draw air through the exchanger 10 to the supplied environment 16 or external environment 14, respectively.

The exchanger 10 also includes a number of components designed to control heat transfer to and from the air expelled by the supply blower 52 and exhaust blower 54. These components include a supply coil 56 and exhaust coil 58. The supply coil 56 and exhaust coil 58 are coupled to each other, as well as a heat source 60 and compressor 62, by a pair of valves 64 and 66 and conduits 68. A controller 70 controls the operation of these components to achieve the desired heat transfer at the supply and exhaust coils 56 and 58, as will be described in greater detail below.

Reviewing each of these components of exchanger 10 in greater detail, the external filter 46 is supported by a pair of channels defined by the housing, immediately inside the rain hood 40. The filter 46 effectively defines one wall of the air exchange chamber 28. Air flowing along the external air path 18 passes directly through the external filter 46 into the air exchange chamber 28. Thus, filter 46 removes particulate and other foreign matter from the external air before it reaches the exchange chamber 28 or supplied environment 16. The external filter 46 may be, for example, a deep pleated or charcoal-type filter.

The return filter 48 is similarly supported by a pair of channels defined by the housing. Filter 48 separates the air return chamber 32 from the air exchange chamber 28 and effectively defines a second wall of the exchange chamber 28. Air flowing along the return air path 20 enters the air exchanger 10 through an opening in the bottom of the air return chamber 32 and passes through the return filter 48 as it enters the air exchange chamber 28. Thus, filter 48 removes particulate and other foreign matter from the return air before it reaches the exchange chamber 28 or supplied environment 16. Filter 48 is preferably of the same construction as filter 46.

The supply blower 52 and exhaust blower 54 cooperatively draw air into exchanger 10 along the external and return air paths 18 and 20, and force air out of exchanger 10 along the exhaust and supply air paths 22 and 24. More particularly, the supply blower 52 is mounted in the air supply chamber 30. Supply blower 52 draws air into chamber 30 across the exposed surface of the supply coil 56. Blower 52 then forces air out of chamber 30, through a vent located in the bottom of the chamber 30 and the adjacent roof 12, into the supplied environment 16.

The exhaust blower 54 is mounted in the air exhaust chamber 34. Exhaust blower 54 draws air into chamber 34 across the exposed surface of the exhaust coil 58. Then, blower 54 forces air out of chamber 34, through the back-draft damper 42, to the external environment 14.

Both the supply and exhaust blowers 52 and 54 are of conventional design. In that regard, in a five-ton system 10, each may include a 0.5 to 1.5 horsepower motor and a forward-curve fan that are cooperatively designed to move a nominal volume of 2000 cubic feet per minute (cfm) of air. The operation of each blower 52 and 54 is controlled by inputs from controller 70. As a result, the controller 70 can regulate the relative operation of blowers 52 and 54 to achieve the desired overpressure, underpressure, or neutral-pressure air circulation in the supplied environment 16.

Turning now to the supply and exhaust coils 56 and 58, the supply coil 56 effectively defines a wall between the air exchange chamber 28 and the air supply chamber 30. Supply coil 56 includes a conduit through which heated or cooled transfer fluid may be circulated. The length of the conduit is selected to ensure that the interval of time required for the fluid to traverse the coil is sufficient to allow the desired heat transfer between the fluid and the air flowing across the coil 56. The surface area and layout of the conduit are further selected to enhance heat transfer, without presenting an undue resistance to the flow of air from the exchange chamber 28, across the surface of the conduit, to the supply chamber 30.

The exhaust coil 58 effectively defines a wall between the air exchange chamber 28 and the air exhaust chamber 34. Thus, coil 58 allows heat to be transferred between the fluid flowing through coil 58 and the air in the exhaust path 22 flowing over it. In a five-ton system 10, coils 56 and 58 are preferably of the tube and fin type, having a nominal rating of 60 MBtus. As will be appreciated, although a single supply coil 56 and single exhaust coil 58 are shown in FIG. 2, primary and secondary coils may be used for each.

As noted previously, coils 56 and 58 are coupled to the heat source 60 and compressor 62 by a pair of valves 64 and 66 and conduits 68. The valves 64 and 66 are selectively controllable by controller 70 to allow one or both coils 56 and 58 to be coupled to either heat source 60 or compressor 62, depending upon the particular form of heat transfer desired. As will be appreciated, the connection and construction of these components can be altered in a variety of ways.

In that regard, these components will be discussed in greater detail by first considering their use to heat air flowing along the supply air path 24 to the supplied environment 16. The heat source 60 is a device, such as a gas heater, located in the first control chamber 36 of housing 26. The heat source 60 is included to heat the transfer fluid and, for example, pump it to the supply coil 56. Source 60 preferably has a rating of 60 MBtus, with its actual output being variable.

The heat source 60 is physically coupled to the supply coil 56 by conduits 68 and valves 64 and 66. The valves 64 and 66 are four-way, electromechanical devices that respond to outputs from the controller 70 to switch the flow of transfer fluid to the various components of the heat transfer system as desired. In that regard, when the controller 70 determines, in a manner described in greater detail below, that air in the supply air path 24 is to be heated, valve 66 is operated to direct heat transfer fluid from heat source 60, through a first conduit to the supply coil 56. Valve 66 is similarly operated to direct fluid from the supply coil 56, through a second conduit, .back to the heat source 60. During this interval, valves 64 and 66 isolate the exhaust coil 58 and compressor 62 from the closed loop traversed by the heated transfer fluid.

The flow of heated fluid from source 60 through the supply coil 56 raises the temperature of supply coil 56. As the supply blower 52 draws air from the exchange chamber 28 through the supply coil 56, the air is heated and blower 52 then blows the heated air into the supplied environment 16. The controller 70 regulates the operation of the supply blower 52, heat source 60, and valves 64 and 66 until the desired temperature is achieved in the supplied environment 16.

In an energy recovery mode of operation, the controller 70 provides outputs to valves 64 and 66, causing them to couple the exhaust coil 58 in series with the heat source 60 and supply coil 56. Before reaching the external environment 16, heat from the air flowing across the exhaust coil 58 is transferred to the fluid flowing through coil 58. The fluid is then circulated through the heat source 60 to the supply coil 56. As a result, the energy retrieved from air in the exhaust path 22 Is available to be returned to the supplied environment 16 by the supply coil 56, increasing the efficiency of the exchanger 10 in this mode of operation. In one embodiment wherein coils 56 and 58 are coupled to compressor 62, valve 64 and valve 66 each include expansion valves associated with a check valve to direct a refrigerant either around (i.e., bypass) or through the respective expansion valve, depending on whether the system is the heating or the cooling mode. With this system, heating can be accomplished by allowing compressor 62 to direct high temperature, high pressure gas to supply coil 56 where it condenses to a liquid. The condensed liquid is bypassed around the expansion valve element of valve 66 and is delivered through the expansion valve element of valve 64 where it atomizes and has its pressure and temperature reduced. The refrigerant then passes through exhaust coil 58 and returns to compressor 62 as a low pressure gas. Compressor 62 then introduces energy into the gas by compressing and the cycle is repeated.

When the exchanger 10 is called upon to cool the air introduced into the supplied environment 16 along supply path 24, the controller 70 provides output signals to valves 64 and 66 to reconfigure the heat transfer system. More particularly, valves 64 and 66 respond to the output signals by coupling the supply coil 56, exhaust coil 58, compressor 62, and associated conduits in a series loop.

In this arrangement, the supply coil 56 is used as an evaporator. The exhaust coil 58 is used as the condenser. The compressor 62 produces the pressure changes in the fluid required to achieve the desired cooling of the supplied environment 16. More particularly, the expansion of the fluid cools coil 56 and, hence, the air flowing across coil 56 to the supplied environment 16. The heat introduced into the fluid at coil 56 is then transferred to the exhaust coil 58 as the fluid is condensed.

The heat of the exhaust coil 58 is then transferred to the external environment 14 by the air flowing across coil 58 along the exhaust path 22. As will be described in greater detail below, the controller 70 simply regulates the operation of the supply blower 52, valves 64 and 66, and compressor 62 until the desired temperature has been achieved in the supplied environment. Controller 70 may also initiate energy recovery in this mode, linking the exhaust and supply coils 58 and 56 to allow previously cooled air flowing across the exhaust coil 58 to reduce the temperature of coil 58 and the transfer fluid. As a result, the discharge head pressures are reduced, increasing the system's cooling capacity and involving less energy consumption. In the cooling mode, hot gas from the compressor is delivered to exhaust coil 58 where it condenses to a liquid at high pressure and temperature. The condensed liquid is bypassed around the expansion valve element of valve 64 and is delivered through expansion valve element of valve 66 where its pressure and temperature are reduced before delivery to supply coil 56. In supply coil 56, the refrigerant is evaporated and cools the air flowing over the coil.

Figure 4:
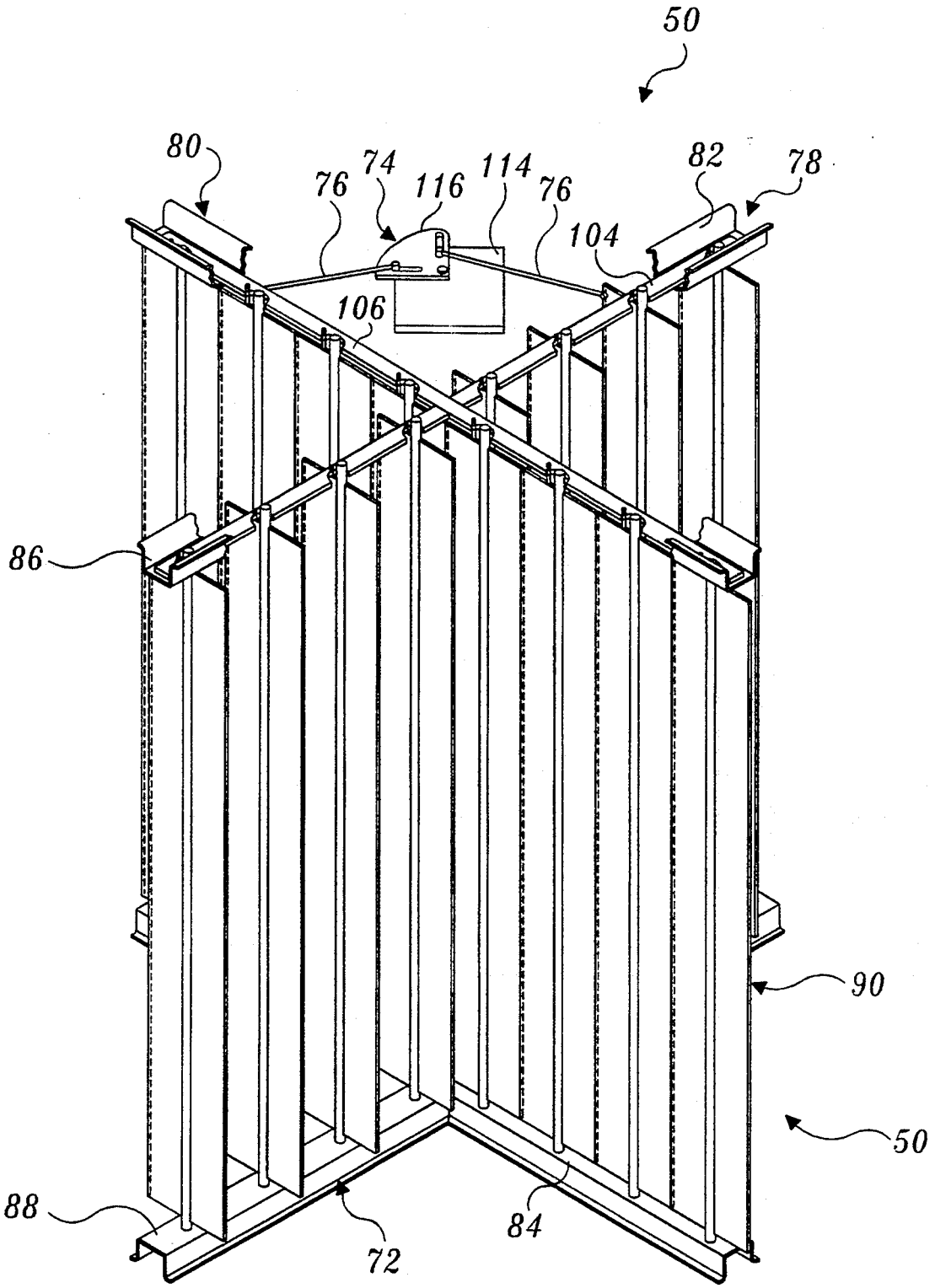
FIG. 4 illustrates a crossed damper and damper actuator included in the air exchanger of FIG. 1 to direct the flow of air through the exchanger.

As previously noted, the damper and actuator assembly 50 is responsible for regulating the flow of air from the external and return air paths 18 and 20 to the exhaust and supply air paths 22 and 24 of the integrated air exchanger 10. In the preferred arrangement, the assembly 50 includes a crossed or X-shaped damper 72, actuator 74, and linkage 76, positioned in the exchange chamber 28 as shown in FIGS. 2 and 4.

Reviewing these various components in greater detail, the crossed damper 72 includes a return/supply (R/S) arm 78, supply/external (S/E) arm 80, external/exhaust (E/E) arm 82, and exhaust/return (E/R) arm 84. The four arms 78, 80, 82, and 84 intersect along a vertical axis centered in the exchange chamber 28 of housing 26. The R/S arm 78 extends to the corner of chamber 28 defined by filter 48 and coil 56. The S/E arm 80 extends to the corner defined by filter 46 and coil 56. The E/E and E/R arms 82 and 84 extend to the corners defined by coil 58 and filters 46 and 48, respectively. Collectively, these arms give the damper 72 its crossed configuration.

As will be described in greater detail below, the R/S arm 78 regulates the flow of air from the return path 20 to the supply path 24. The S/E arm 80 regulates the flow of air from the external path 18 to the supply path 24. Similarly, the E/E and E/R arms 82 and 84 regulate the flow of air from the external and return paths 18 and 20 to the exhaust path 22.

Figure 5:
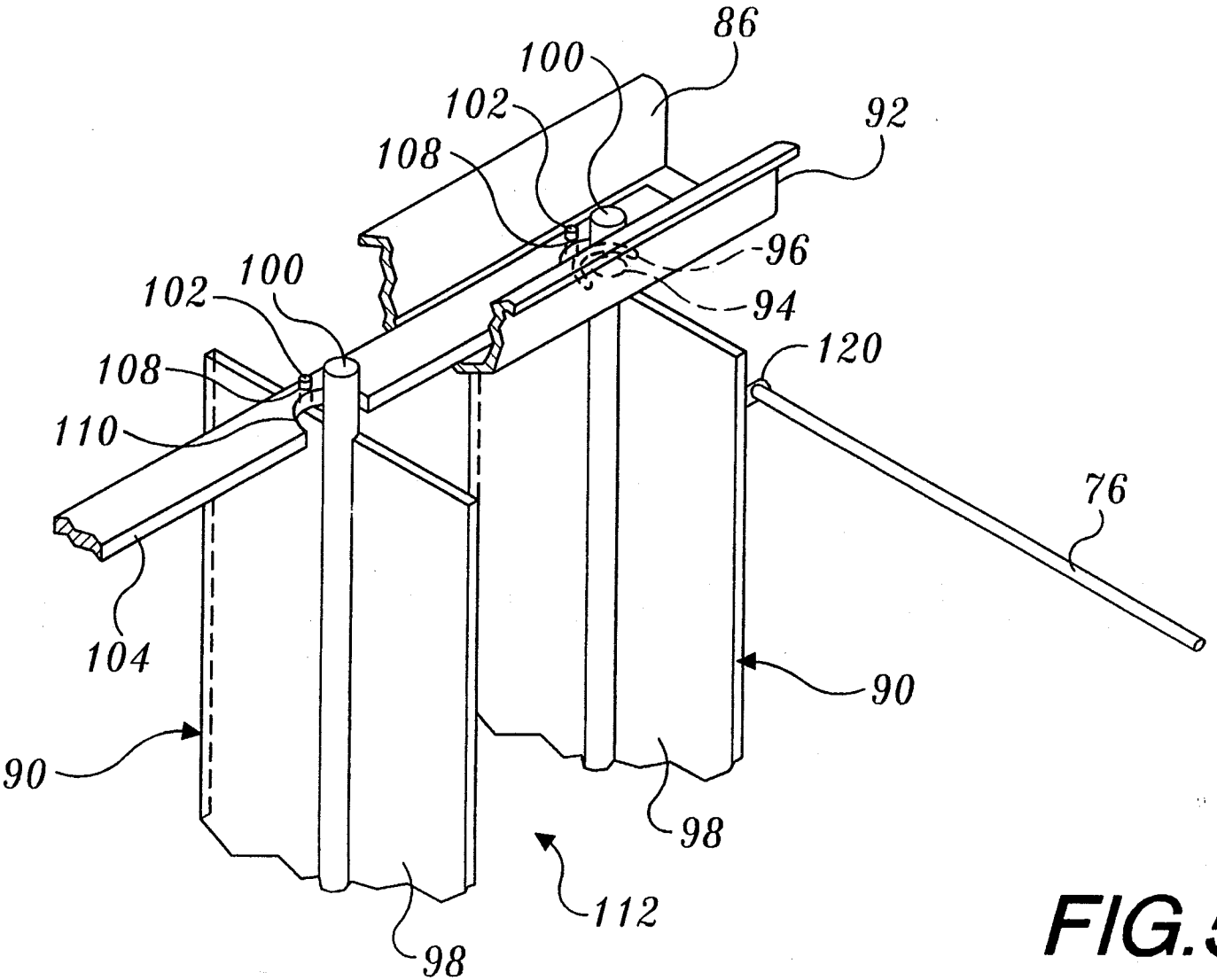
FIG. 5 is a more detailed illustration of a portion of the crossed damper of FIG. 4.

Reviewing the construction of, for example, the R/S arm 78 in greater detail, arm 78 includes a roughly U-shaped top piece or channel 86 and similarly shaped bottom piece 88 that cooperatively support a plurality of dampers 90. In that regard, as shown in greater detail in FIG. 5, the top piece 86 includes a damper support surface 92 provided with a plurality of openings 94, which are spaced apart the length of surface 92. Adjacent each opening 94, and to one side thereof, is a slot 96. The bottom piece 88 is constructed in the same manner as top piece 86, except that the slots 96 are omitted.

Each damper 90 extending between the top and bottom pieces 86 and 88 is a single element having a number of different sections. In that regard, the body of the damper is formed by a vane 98. The vane 98 is a relatively flat element, whose width is, for example, slightly greater than the spacing of openings 94 to ensure that the vanes 98 can be rotated to overlapping positions. A stubby shaft 100 projects from each end of the vane 98, along its axis. The shafts 100 are dimensioned to be received within corresponding openings 94 in the top and bottom pieces 86 or 88. As a result, the vane 98 is free to pivot about its axis.

At one end of the vane 98 a linkage pin 102 is provided, spaced apart from and parallel to the shaft 100. The pin 102 extends through the corresponding slot 96 in the top piece 86. Pins 102 and slots 96 are correspondingly dimensioned to allow pin 102 to freely reciprocate in slot 96 when the vane 98 pivots.

The pins 102 are used to link the various dampers 90 in the following manner. All of the pins 102 projecting through the slots 96 in the top pieces 86 of arms 78 and 82 are linked by a first linkage bar 104. Similarly, all of the pins 102 projecting through the slots 96 in the top pieces 86 of arms 80 and 82 are linked by a second linkage bar 106.

The first linkage bar 104 is received within the channel formed in the top pieces 86 of the R/S and E/E arms 78 and 82. A plurality of pin openings 108 are provided in linkage bar 104, spaced apart by a center-to-center distance corresponding to that of openings 94 in the top piece 86. The openings 108 are dimensioned to rotatably receive the pins 102 on vanes 98. When the linkage bar 104 is moved longitudinally with respect to the top pieces 86 of arms 78 and 82, each of the vanes 98 in those arms will rotate in unison at the same angle relative to the general plane of arms 78 and 82. If desired, however, the spacing of pin openings 108 could be varied to alter the relative angle of the vanes 98 and achieve a nonuniform vane alignment in arms 78 and 82.

The side of linkage bar 104 adjacent the shafts 100 includes a plurality of recesses 110 that allow the bar 104 to move longitudinally without interfering with the shafts 100. The dimensions of the slots 96 in the top pieces 86 and the recesses 110 in the bar 104 are sufficient to allow bar 104 to be moved over a range extending between open and closed positions, described in greater detail below.

With bar 104 in the open position, the vanes 98 in arms 78 and 82 are substantially parallel to each other and normal to the general plane of the arms 78 and 82. As a result, openings 112 are provided between each vane 98, through which air may readily flow. When bar 104 is in the closed position, on the other hand, the vanes 98 are generally aligned with the plane of arms 78 and 82, with the edges of adjacent vanes 98 in contact with each other. As a result, air is substantially prevented from flowing through arms 78 and 82.

The second linkage bar 106 is similarly constructed and links the pins 102 of the vanes 98 included in the S/E and E/R arms 80 and 82. As a result, the movement of bar 106 longitudinally with respect to the top pieces 86 of arms 80 and 82 will cause each of the vanes 98 in arms 80 and 82 to rotate in unison. Like bar 104, bar 106 can be rotated between open and closed positions in which the vanes 98 allow air to flow, and block its passage, respectively. The second bar 106 passes over the first bar 104 at the center of the damper 90.

Turning now to the manner in which the linkage bars 104 and 106 are actuated between their closed and open positions, reference is again had to FIGS. 2 and 4. As shown, the actuator 74 is coupled to one vane 98 of the R/S and E/E arms 78 and 82, as well as to one vane 98 of the S/E and E/R arms 80 and 84, by two linkage rods 76. The actuator 74 and linkage rods 76 rotate these two vanes 98 between the desired open and closed positions. The linkage bars 104 and 106 then ensure that the remaining vanes 98 are appropriately positioned.

The actuator 74 includes a motor 114 and actuator plate 116. The motor 114 may have any one of a variety of constructions and its operation is regulated by the controller 70. The actuator plate 116 is coupled to the shaft of motor 114, which is rotatable over a 90-degree range.

The actuator plate 116 is shaped roughly like a sector of a circle and includes a pair of linkage slots 118 (FIG. 2). One end of each linkage rod 76 is received within a corresponding one of the slots 118 and reciprocates within the slot as the plate 116 is rotated between first and second positions. The other end of each linkage rod 76 is coupled to the corresponding vane 98 by a universal joint 120, shown in greater detail in FIG. 5.

In FIG. 2, the actuator plate 116 is in a first position. In this position, the linkage rod 76 coupled to the vane 98 in arm 82 pulls it open, while the linkage rod 76 coupled to the vane in arm 80 pushes it closed. Thus, the vanes in the R/S and E/E arms 78 and 82 are open, while the vanes in the S/E and E/R arms are closed. When the actuator plate 116 is rotated 90 degrees, to the position shown in FIG. 8, the linkage rods 76 push the vane 98 in arm 82 closed and pull the vane 98 in arm 80 open. As a result, the vanes in the R/S and E/E arms 78 and 82 are closed, while the vanes in the S/E and E/R arms 80 and 84 are open.

As will be appreciated, the damper and actuator assembly 50 could have alternative constructions. For example, an actuator plate, linked to one vane in the R/S and E/E arms and one vane in the S/E and E/R arms, could be rotatably supported above the damper about an axis coinciding with the intersection of the four arms of the damper. Such an actuator plate could be rotated by a stepper motor, either directly or through intervening gears. By centrally locating the actuator plate, a single plate could also be easily linked directly to one vane in each of the four arms, allowing the force used to open and close the vanes to be more widely distributed across the arms.

Another alternative actuator construction involves the use of separate actuator assemblies to control the operation of the two linked arm pairs. Similarly, with a separate linkage bar coupling the vanes in each arm, four independent actuator assemblies could be employed to separately regulate the operation of the arms.

Figure 7:
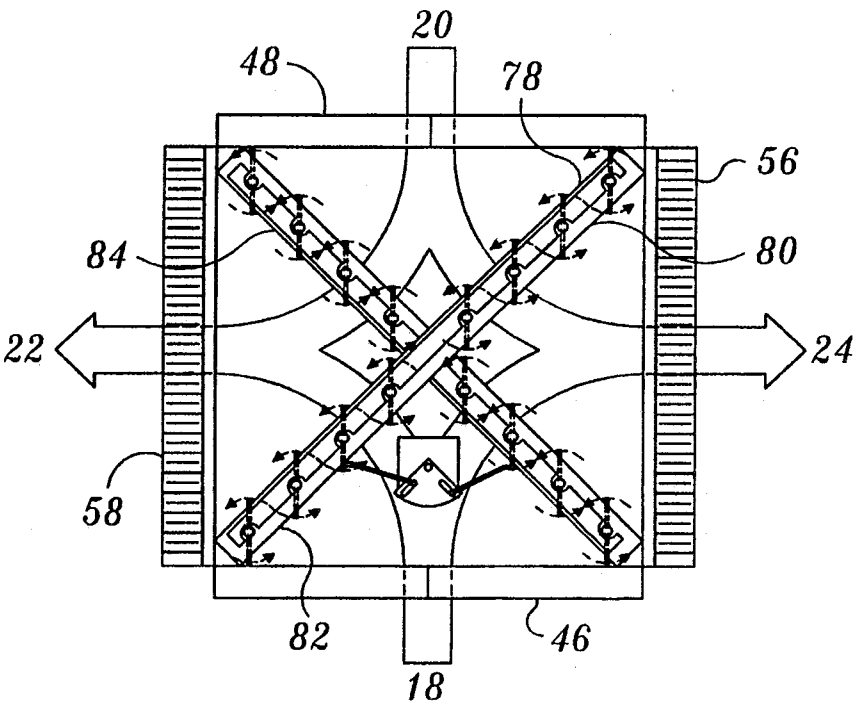
FIGS. 6, 7, and 8 schematically illustrate the operation of the damper of FIG. 4 under various conditions.
Figure 6:
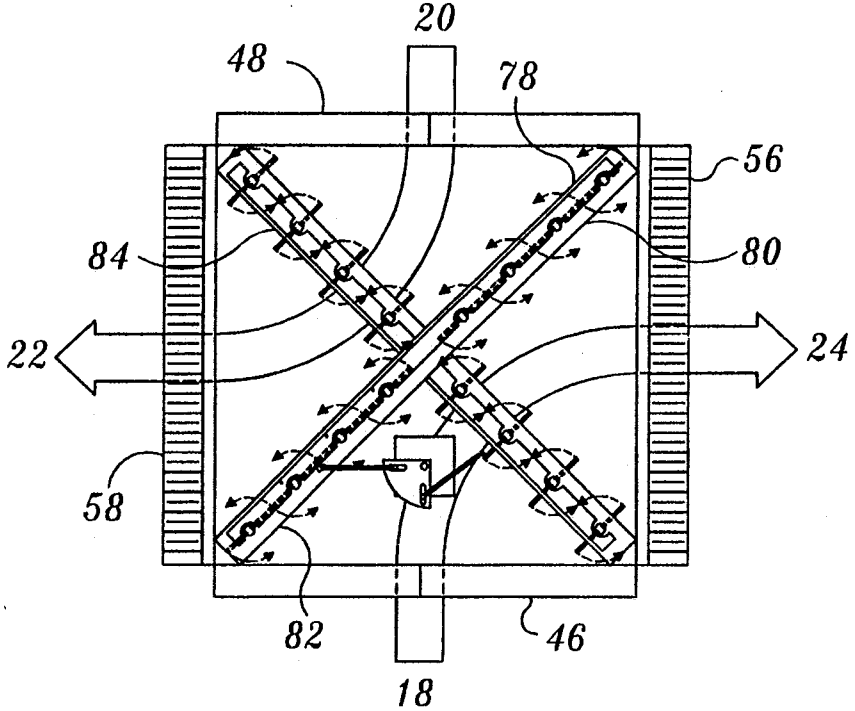
Figure 8:
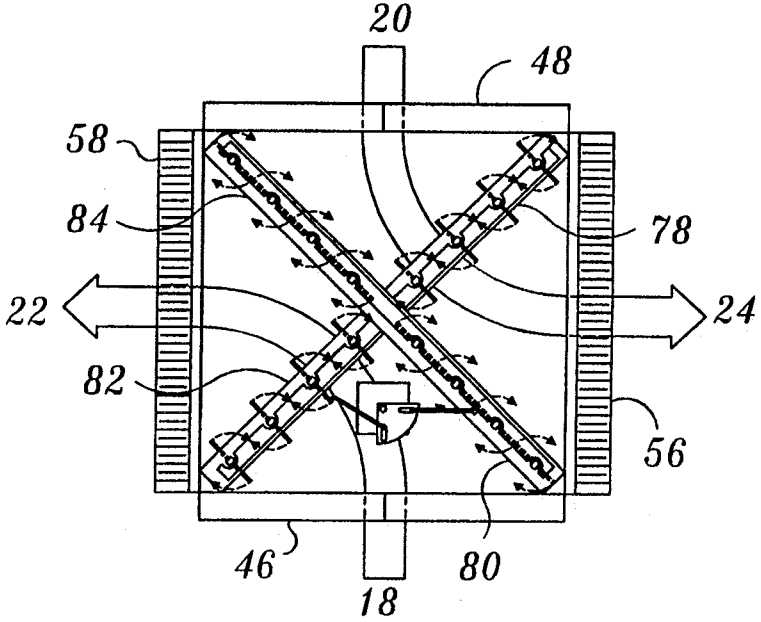

Reviewing now the basic operation of the crossed damper 90 to achieve the desired airflow, reference Is had to FIGS. 6, 7, and 8. As noted previously, the supply and exhaust blowers 52 and 54 draw air into the exchanger 10 from the external and supplied environments 14 and 16 along the external and return air paths 18 and 20 before discharging the air again to environments 14 and 16 along the exhaust and supply air paths 22 and 24. The crossed damper assembly 50 regulates the relative flow between these paths in response to the controller 70.

The operation of the crossed damper assembly 50 is largely a function of the desired ventilation. In that regard, FIG. 6 illustrates the operation of the crossed damper 90 when maximum ventilation is to be achieved. As shown, the R/S and E/E arms 78 and 82 are closed. The S/E arm 80 of damper 90, however, is open and allows substantially unrestricted flow of air from the external environment 14 to the supplied environment 16 along the external air path 18 and supply air path 24. Similarly, the E/R arm 84 is open and allows air from the supplied environment 16 to flow without restriction to the external environment 14 along the return air path 20 and exhaust air path 22.

When a reduced level of ventilation is desired, the controller 70 regulates the operation of damper 90 in the manner shown in FIG. 7. More particularly, each of the arms 78, 80, 82, and 84 is now partially open. As a result, air introduced through the external air path 18 is partially diverted to flow through the exhaust air path 22 and the supply air path 24. Similarly, air from the supplied environment 16 introduced through the return air path 20 is divided between the exhaust air path 22 and supply air path 24. By controlling the damper position, the relative contribution of the external and return air paths 18 and 20 to the supply air path 24 can be regulated as desired. Similarly, the contribution of the external and return air paths 18 and 20 to the exhaust path 22 can be controlled.

Finally, the damper 90 can also be controlled to provide no ventilation, or maximum recirculation. As shown in FIG. 8, the R/S and E/E arms 78 and 82 are open, while the S/E and E/R arms 80 and 84 are closed. Air from the return path 20 is directed to the supply path 24 and the air from the external path 18 is all passed to the exhaust path 22. As a result, there is no exchange of air between the external environment 14 and supplied environment 16.

As will be appreciated from the preceding discussions, the exchanger 10 is an integrated unit that performs heating, ventilation, and cooling. The control of these various functions is handled by controller 70. The controller 70 may be, for example, a microprocessor-based system including a microprocessor, interfaces, memory, and input and output peripherals. The microprocessor receives inputs from a variety of sensors, via the interfaces, and analyzes the inputs in accordance with program instructions stored in memory to produce the output required to achieve the desired regulation of the air introduced into the supplied environment.

Briefly reviewing this operation in greater detail, as noted, the controller 70 receives a number of different inputs. For example, the controller 70 may include an operator control panel that allows an operator to input the desired heating, ventilation, and cooling to be achieved. The controller 70 may also receive an indication of the supplied room temperature, humidity, and air composition from a plurality of sensors included in the control panel. An ambient air temperature sensor may further be included, as part of controller 70, in the section of the exchange compartment 28 of housing 26 including external airflow path 18. Similarly, a return air temperature sensor may be included in the return air path section of the exchange compartment The controller 70 responds to these inputs in the following manner, causing the air exchanger 10 to operate in any one of, for example, three different major modes: power off, unoccupied, and occupied. In addition, the occupied mode includes a number of submodes, such as the warmup, economizer, ventilation, heating, cooling, and defrost submodes of operation.

In the power-off mode, the controller 70 deactivates all of the exchanger's electrical components. An output to actuator 74 maintains the damper 90 in the recirculation position shown in FIG. 8 or, alternatively, in the same position it was in when the power was turned off.

Addressing now the unoccupied mode, the controller 70 also provides an output to actuator 74 to again maintain the damper 90 in the recirculation position of FIG. 8 because, in the unoccupied mode, the controller 70 is programmed to assign the conservation of energy a higher priority than the provision of fresh air to environment 16. A nominal temperature to be maintained in the supplied environment 16 when unoccupied is also programmed into the controller 70. The controller 70 intermittently activates the supply blower 52, as well as the heating or cooling systems, in the manner described above, to maintain the desired nominal temperature. Because the supplied environment 16 is not occupied, the temperature to be maintained will typically be set to require less energy from the exchanger 10 than if the environment were occupied. The controller 70 may also be programmed to allow the temperature to fluctuate over some wider range in the unoccupied mode before initiating corrective action.

Turning now to the occupied mode of operation, during warmup, the damper 90 is kept in the recirculation position of FIG. 8 initially to recirculate the air and increase the speed at which the temperature of the supplied environment 16 can be altered. Once the temperature crosses (i.e., rises above or below) a warmup threshold programmed into the controller 70, the controller 70 enters the appropriate one of the submodes discussed below.

With the ventilation submode selected, the controller 70 modulates the operation of damper 90 between the positions illustrated in FIGS. 6, 7, and 8, depending upon the ventilation required. For example, the controller 70 may be programmed to maintain the quality of the supplied environment's air (e.g., relative humidity and carbon dioxide), as sensed at the control panel or return air sensor, within certain ranges. The controller 70 does not attempt to maintain air quality during warmup or when in the unoccupied mode, although the controller 70 may override the economizer submode of operation discussed below to achieve the desired air quality.

In the ventilation submode, the controller 70 may also regulate the operation of the supply blower 52 and exhaust blower 54 as a function of the modulation of the damper 90. For example, the output of blower 54 may be decreased as the damper 90 is adjusted toward the position shown in FIG. 7. On the other hand, the output of blower 54 may be increased as the damper 90 is adjusted toward the positions shown in FIGS. 6 and 8.

The operation of blowers 52 and 54 may also be regulated to achieve the desired air pressure in the supplied environment 16. More particularly, the controller 70 may respond to the air pressure sensed at the control panel and cause blower 52 to introduce less air into environment 16 than is drawn out by blower 54, when the desired programmed air pressure is less than that of the external environment 14. On the other hand, if the desired air pressure in environment 16 is greater than that of the environment 14, blower 52 is regulated to introduce more air than is withdrawn by blower 54. Alternatively, a ventilation control means for producing an output indicative of a desired volume of air flowing in said supply air path and said exhaust air path can be provided. A damper actuator means for receiving said ventilation control output and controlling the position of said damper vanes in said damper arms in response thereto serves to provide a means for adjusting the air pressure in supplied environment 16.

Another technique for maintaining the desired air pressure in the supplied environment 16 requires a modification of the control of the crossed damper 90. Specifically, the vanes 98 in the R/S arm 78 are connected by one linkage bar, while the vanes 98 in the S/E, E/E, and E/R arms 80, 82, and 84 are connected by three other linkage bars. As noted above, a separate actuator may then be used to control the vanes in each arm. The basic operation of the arms remains the same as discussed above in connection with the single actuator embodiment. The use of multiple actuators, however, allows the air volume supplied to environment 16 to differ from the air volume drawn from environment 16. The controller 70 simply regulates the operation of the actuators to achieve the desired pressure differential.

Addressing now the heating submode of occupied operation, when the controller 70 analyzes the various Input signals and determines that a relatively small amount of heat is required to achieve the desired temperature, a first stage of heating is entered. In this stage, the controller 70 activates the heat source 60 and the valves 64 and 66 to heat the transfer fluid and circulate it through the supply coil 56. As a result, the air flowing to the supplied environment 16 is heated in a specific embodiment, a supply air control means for producing a supply air temperature control output indicative of a desired temperature of air flowing in the supply air path is provided. The supply energy transfer means receives and responds to the supply air temperature control output by influencing the temperature of air flowing in said supply air path.

Depending upon the nature of Its program instructions, the controller 70 may select one of several positions for the damper 90 in this situation. For example, the controller 70 may adjust the damper 90 to the recirculation position shown in FIG. 8. In this position, the exchanger 10 operates as a heat pump, with all of the air passing over the supply coil 56 coming directly from the supplied environment 16. Alternatively, the damper 90 may be adjusted to the ventilation position shown in FIG. 6. In this position, the exchanger 10 operates as a heat recovery unit, with the return air being directed across the exhaust coil 58 for heat recovery. As will be appreciated, the position of damper 90 may also be regulated anywhere between these two extremes.

If the controller 70 determines that more substantial heating is required to achieve the desired temperature in the supplied environment 16, additional stages of heating may be entered. For example, the output of the heat source 60 can be increased or additional sources brought on line. As the desired temperature is reached, the controller 70 may gradually stage off the heating in reverse fashion.

Turning now to the operation of the controller 70 to cool the supplied environment, the controller 70 initially enters a first cooling stage of operation. In that stage, the controller 70 instructs valves 64 and 66 to couple the supply coil 56 to the compressor 62. If the controller 70 determines that the air temperature in the supplied environment 16 is below the programmed desired temperature, the compressor 62 is left unloaded and the damper 90 is modulated to maintain the set temperature by regulating the contributions of air from the external air path 18 and return air path 20 to the supply air path 24. If some cooling is required, the controller 70 will gradually load the compressor 62, cooling the supply coil 56 and, hence, the air introduced into the supplied environment 16.

If a greater degree of cooling is required, the controller 70 initiates a second cooling stage. The operation of the exchanger 10 will differ depending upon whether an economizer submode or normal submode of cooling is pursued. Addressing first the normal cooling submode, the controller 70 continues to monitor the supply, return, and external air temperatures, as well as the operation of the compressor 62, to regulate the operation of the various components accordingly. In that regard, a greater load will be placed upon the compressor 62 or, alternatively, an auxiliary cooling system may be called upon.

The controller modulates the damper 90 as follows. The damper 90 may be set in the recirculation position of FIG. 8, allowing only air from the return path 20 to flow across the supply coil 56 to the supplied environment 16. In this position, the exchanger 10 operates like a conventional air-conditioning unit. Alternatively, the damper 90 may be set in the ventilation position of FIG. 6. As a result, return air is directed across the exhaust coil 58 and external air is directed across the supply coil 56 to the supplied environment 16. In this arrangement, the temperature of the air flowing across condenser 58 is lowered, increasing efficiency. As will be appreciated, the damper 90 is most commonly regulated between these two extremes.

In the economizer submode, the controller 70 recognizes that the relative temperatures of the airflow in the different paths are such that the desired temperature adjustment can be at least partially achieved without relying upon the transfer of heat from the supply coil 56. Thus, the controller 70 integrates a modulation of the damper 90 with mechanical cooling to achieve the desired temperature. The exhaust blower 54 operates as a power exhaust and is energized as a function of damper modulation to maintain the desired building pressure.

The final mode of operation to be considered is the defrost submode. In that regard, under certain environmental conditions (low temperatures and high humidities), the exhaust coil 58 may frost, limiting its utility as a heat transfer mechanism and reducing system efficiency. A defrost mode of operation may be included to address this problem.

During defrost, the controller 70 shuts the exhaust blower 54 off and sets the damper 90 to the recirculation position of FIG. 8. If the exchanger 10 includes parallel heat transfer systems, only one system at a time is defrosted, allowing the other system to continue to provide the desired heat transfer. As an alternative, an auxiliary heat source, located upstream of the exhaust coil 58, may be used by controller 70 to periodically introduce heat into coil 58 and avoid the need for a separate defrost cycle altogether.

As will be appreciated from the preceding discussion, the integrated air exchanger 10 described above has a number of advantages. For example, by integrating the various HVAC components, a single system is provided that is easy to install, maintain, and service. Further, the crossed damper configuration simply and effectively provides the desired air transfer and direction characteristics.

In addition, the system is relatively compact and can be easily adapted for different situations. For example, although the return and supply air paths 20 and 24 enter and exit chambers 32 and 30, respectively, through the bottom of housing 26, the housing 26 could easily be modified to provide openings in the sides or top of housing 26, as desired. Similarly, the housing 26 could be altered to allow the external and exhaust air paths 18 and 22 to enter through the top or bottom of housing 26, rather than through its sides.

In the arrangement discussed above, the crossed damper 90 plays an important role in allowing the desired integration of the various system components to be achieved. The crossed damper 90 is also relatively compact, allowing coils 56 and 58 to be positioned closer to, and more uniformly in, the mixing path to achieve higher efficiencies. As will be appreciated, however, alternative damper designs can be developed to allow the desired integration to be achieved.

Figure 9:
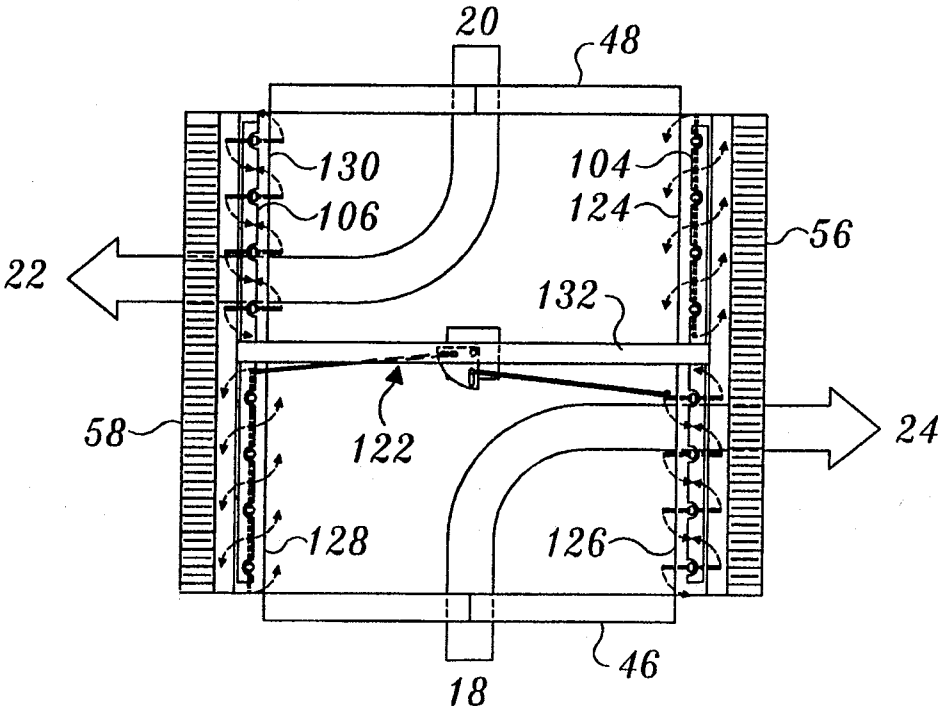
FIG. 9 schematically illustrates an alternative H-shaped damper for use in the air exchanger of FIG. 1.

One such alternative embodiment is the H-shaped damper 122 shown in FIG. 9. Like damper 90, damper 122 is positioned in the air exchange compartment 28 of housing 26 to mix the airflow through filters 46 and 48 and coils 56 and 58. The damper 122 includes R/S, S/E, E/E, and E/R arms 124, 126, 128, and 130, having largely the same construction as the arms of damper 90. The differences between the arms of damper 122 and those of damper 90 are as follows.

The R/S and S/E arms 124 and 126 are substantially aligned parallel to and adjacent the supply coil 56. Similarly, the E/E and E/R arms 128 and 130 are substantially aligned parallel to and adjacent the exhaust coil 58. A wall 132 extends between the junction of arms 124 and 126 and the junction of arms 128 and 130, midway between the filters 46 and 48. Thus, unlike the crossed damper configuration, the R/S and E/E arms 124 and 128 are not aligned and the S/E and E/R arms 126 and 130 are also not aligned.

As a result, the R/S and S/E arms 124 and 126 are now linked by the first linkage bar 104, while the E/E and E/R arms are linked by the second linkage bar 106. If the vanes 98 in the R/S arm 124 are to be open when the vanes 98 in the S/E arm 126 are closed, however, the pins 102 in the vanes 98 of the two arms must be coupled to the first linkage bar 104 accordingly. The same is true of the connection between the vane pins 102 of arms 128 and 130 and the second linkage bar 106. Otherwise the construction and operation of the H-damper 122 is the same as the crossed damper 90 discussed above.

Figure 10:
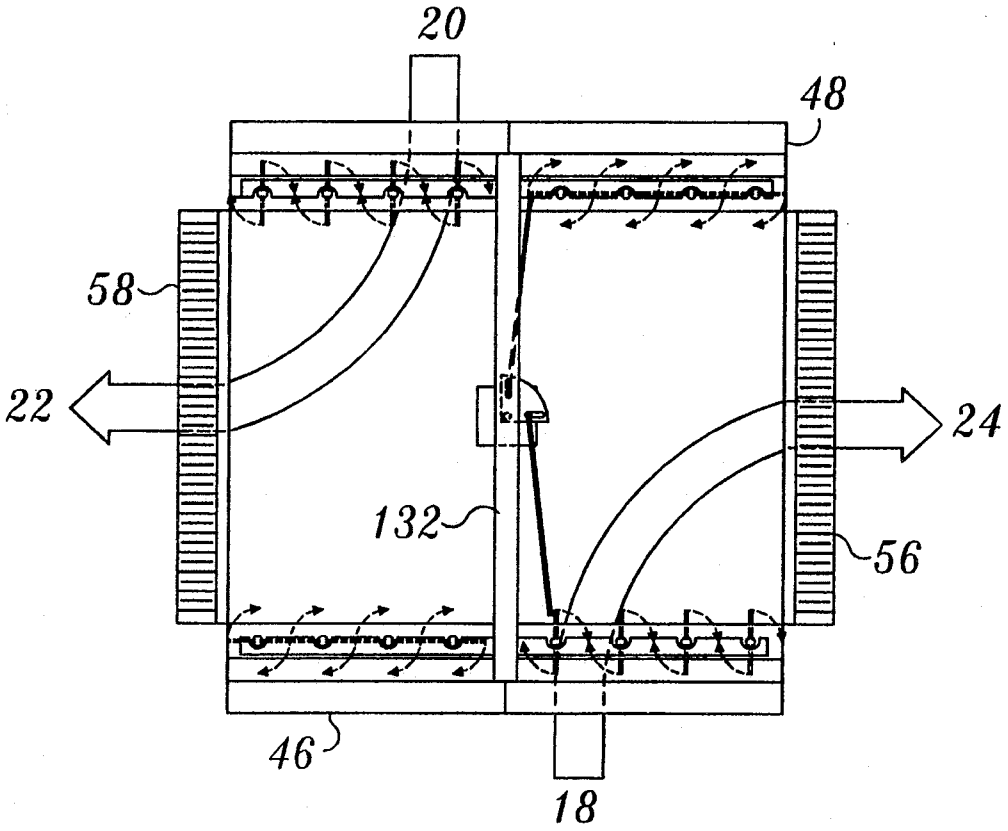
FIG. 10 schematically illustrates an alternative configuration of the H-shaped damper of FIG. 9.

A slight variation in the use of the H-damper 122 is illustrated in FIG. 10. The construction of the damper 122 remains the same. However, the orientation of damper 122, relative to filters 46 and 48 and coils 56 and 58, is altered. More particularly, the damper 122 is rotated 90 degrees, so that the wall 132 is midway between, and parallel to, coils 56 and 58, rather than filters 46 and 48.

As will be readily appreciated from a comparison of FIGS. 9 and 10, the arrangement of FIG. 10 ensures more uniform distribution of air across the supply and exhaust coils 56 and 58. As a result, the efficiency of the heat transfer performed at each coil is enhanced. Thus, the arrangement of FIG. 10 is preferable to that of FIG. 9. If FIG. 10 is compared with FIG. 6, however, it will be appreciated that the crossed damper 90 illustrated in FIG. 6 ensures an even better distribution of air across coils 56 and 58, making it more efficient than the H-damper design.

Figure 11:
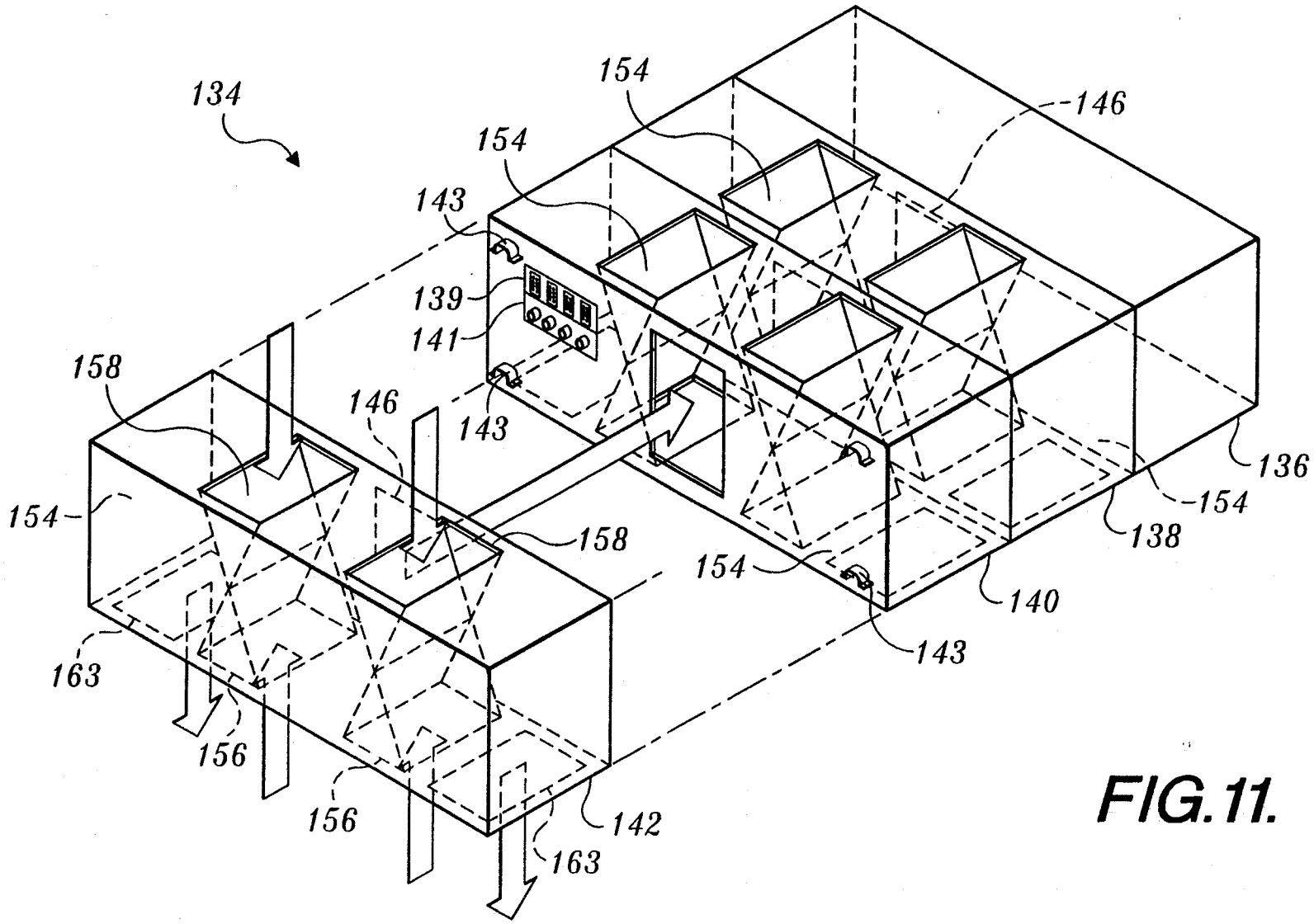
FIG. 11 illustrates an alternative embodiment of the air exchanger of FIG. 1 including a plurality of modules for use with a number of separate regions of a building.

The exchanger 10 described above is primarily intended for use in satisfying the heating, ventilation, and cooling requirements of a single environment. If more than one site or zone is to be handled, several modifications of exchanger 10 have been developed. In that regard, a first multizone exchanger 134 is shown in FIG. 11. The exchanger 134 includes a control compartment 136, a first expansion module 138, second expansion module 140, and "nth" expansion module 142. This dual-stack multizone exchanger 134 allows the needs of "n" different zones to be fully satisfied and the modularity of the design makes it readily adaptable for a variety of different applications and environments.

Figure 12:
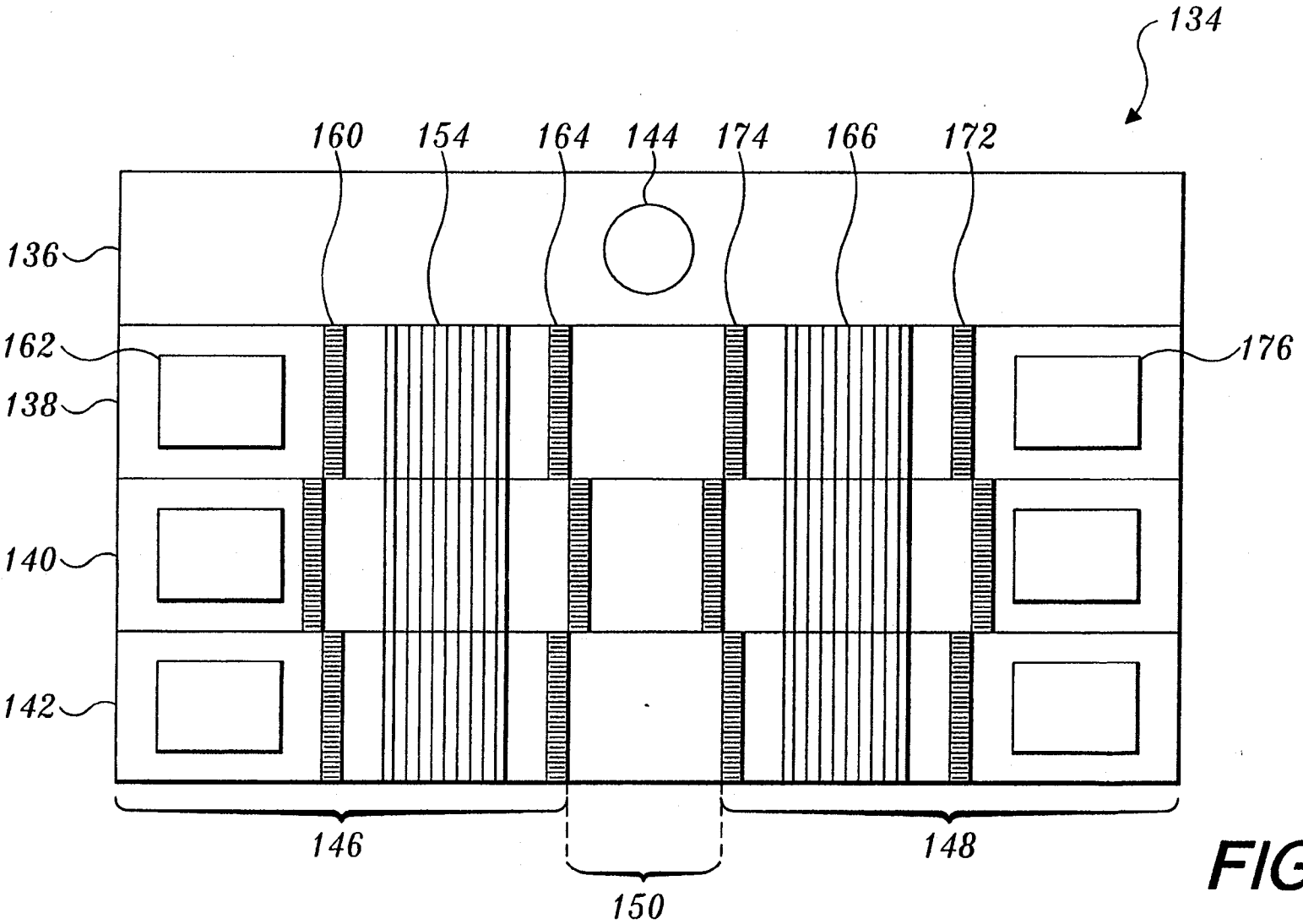
FIG. 12 is a schematic illustration of the air exchanger of FIG. 10.

Reviewing the construction of this embodiment in greater detail, reference is had to FIG. 12. Although not shown in FIG. 12, the control compartment 136 includes a number of components corresponding to those previously discussed in connection with exchanger 10. Thus, these components will be only briefly described.

In that regard, the control compartment 136 includes a controller that is programmed to respond to inputs from the various modules and supplied environments to regulate the operation of exchanger 134 in a manner similar to that of exchanger 10 discussed above. Compartment 136 also includes most of the components of the heat transfer system, including the heat source, compressor, valves, and some conduits. In the preferred arrangement, two separate sets of these components are included, with each being responsible for a different stack of the exchanger 134, as will be described in greater detail below.

The control compartment 136 further includes the single exhaust blower 144 employed by the exchanger 134. As a result, compartment 136 includes an inlet 146, through which the blower 144 draws air to be exhausted from the various modules. A back-draft damper is provided on the opposite side of the compartment 136 as an outlet for the exhausted air.

As will be appreciated, in addition to the air passage formed by inlet 146, a number of electrical and hydraulic connections are required between the compartment 136 and the remaining modules. Modules 138, 140, and 142 can be constructed without any provision for these connections, leaving the wiring and plumbing to be handled on a case-by-case basis after the various modules to be used have been connected to the control compartment 136. In the preferred arrangement, however, each module is preconfigured to provide the necessary electrical and hydraulic connections to the control compartment 136 and other modules.

In that regard, a maximum number of modules that can be employed with the control compartment 136 is determined based, for example, upon the rating of the exhaust blower 144. The side of the control compartment 136 adjacent the first module 138 is then provided with an electrical connector 139 that is designed to engage a mating connector on the first module 138 when attached. The connectors include a sufficient number of pins to allow the controller in compartment 136 to be coupled to the maximum possible number of modules that may be used with compartment 136. Similarly, hydraulic quick-connects 141 are provided on the same side of the housing of compartment 136 to allow the heat transfer components of the compartment 136 to be coupled to up to the maximum number of modules to be used. Mechanical interconnects, such as tongue-and-groove mechanisms or a rack-mounting system, are also included on the housing to mechanically interlock the compartment 136 with the adjacent module 138.

This electrical, hydraulic, and mechanical connection scheme is duplicated in module 138, with one side of module 138 adapted to provide the requisite connections to compartment 136 and the other side adapted to provide the necessary connections to module 140. As will be appreciated, however, because some of the electrical lines from compartment 136 terminate in module 138, the number of pins included in the electrical connectors joining modules 138 and 140 will be less than the number used to join compartments 136 and 140. The same is true of the hydraulic connections. The number of required electrical and hydraulic connections further decreases for each subsequent module.

As will be appreciated, the addition of such a connection scheme to the modules allows them to be joined as a system very quickly. The tradeoff is that a given module must either be specifically designated for use at a given point in the exchanger stack to ensure that the needed connections will be available or each module must be constructed as if it were to be the first to be connected to the compartment 136. As a result, a given module's adaptability is either limited, or the module's expense increased, due to the redundancy of connections used.

Returning to the internal construction of modules 138, 140, and 142, with the exception of the connections discussed above, each module is the same. Thus, reviewing the construction of module 138 for purposes of illustration, as shown in FIG. 12, it includes a first stack half 146 and second stack half 148, joined by a central exhaust chamber 150. The first stack half 146 includes an exchange chamber 152 provided with a crossed damper 154.

The crossed damper 154 is the same as the damper 90 discussed previously but is rotated onto its side, with the intersection of the four arms being parallel to the floor of the housing, rather than extending through it. The damper 154 receives air from a return vent 156 provided on the bottom of the module 138 and an external vent 158 provided on the top of module 138. Damper 154 then directs air off to one side, through a supply coil 160 to a first zone supply blower 162 and out a supply vent 163, or off to another side, through an exhaust coil 164 to the exhaust chamber 150 where it is exhausted by blower 144. As will be appreciated, the control of the crossed damper 154, as well as the heat transfer system and blowers 144 and 164 is in accordance with the control scheme discussed above for the single-zone embodiment.

The general construction of the first stack half 146 is repeated in the second stack half 148. In that regard, an exchange chamber 164 includes a crossed damper 166. The crossed damper 166 receives air from return and external vents 168 and 170 and directs it to supply and exhaust coils 172 and 174. A second zone supply blower 176 is included to force air to the second zone served by the second stack half 148.

As previously noted, this general construction is repeated for each of the modules employed. If exchanger 134 includes three modules, the exchanger 134 can effectively satisfy the heating, ventilation, and cooling requirements of six different zones, even allowing heat recovered from one zone to be supplied to another. Because this arrangement employs a single exhaust blower 144, however, its overall capacity is limited along with the number of zones that can be served. This embodiment also requires a fairly wide housing to accommodate the two stacks.

Figure 13:
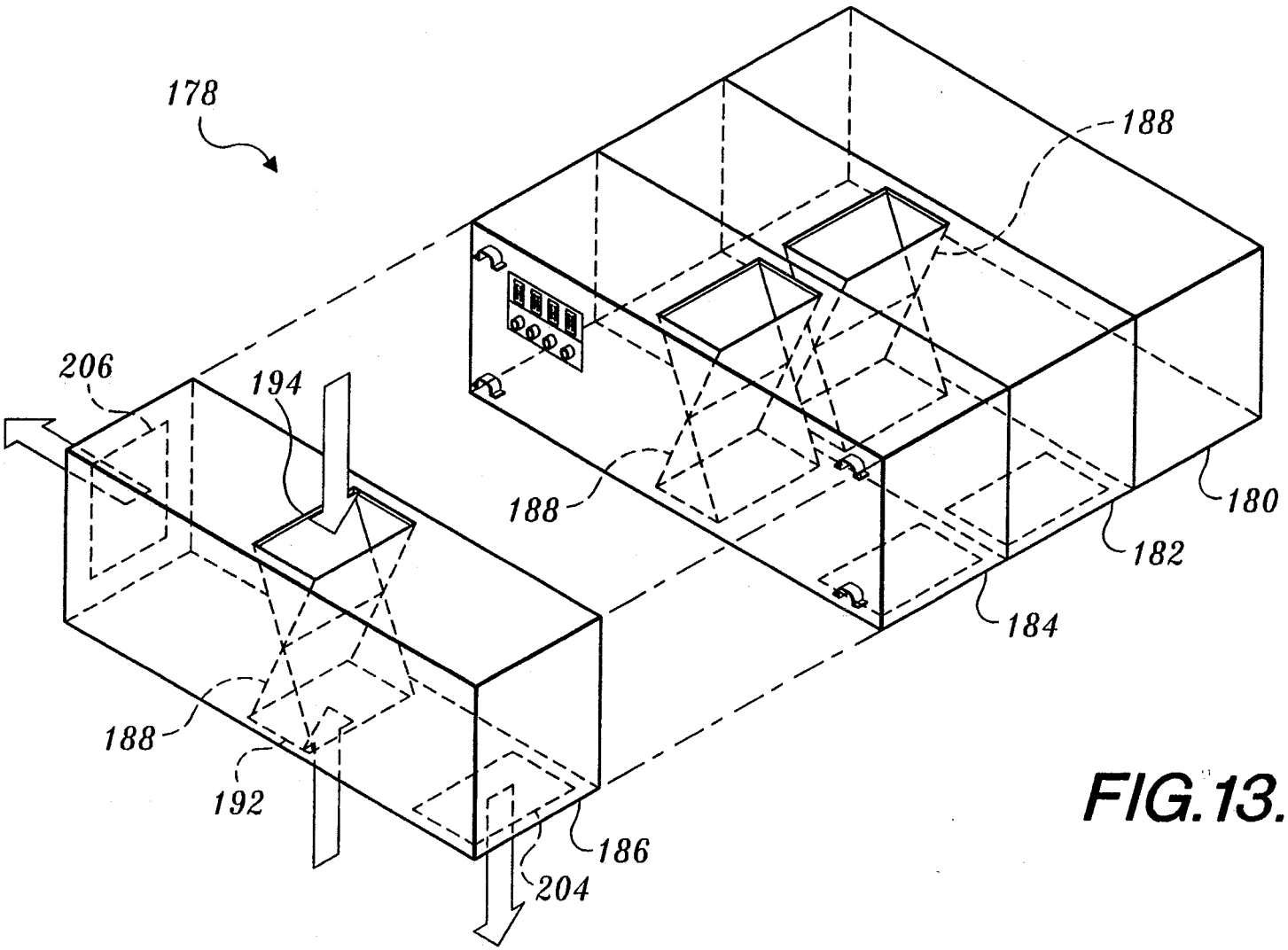
FIG. 13 illustrates another alternative embodiment of the air exchanger of FIG. 1 for use with a number of separate regions of a building.

An alternative, single-stack multizone exchanger 178 is shown in FIG. 13. Again, a single control compartment 180 is employed for use with a plurality of different modules 182, 184, and 186. The use of electrical, mechanical, and hydraulic connections in the manner described with respect to exchanger 134 allows the modules to be quickly assembled to adapt the exchanger 178 for different applications.

The control compartment 180 of exchanger 178 is similar to the control compartment 136 of exchanger 134 except that the blower 144 is deleted. In exchanger 178, each module includes its own exhaust blower, as discussed below.

Figure 14:
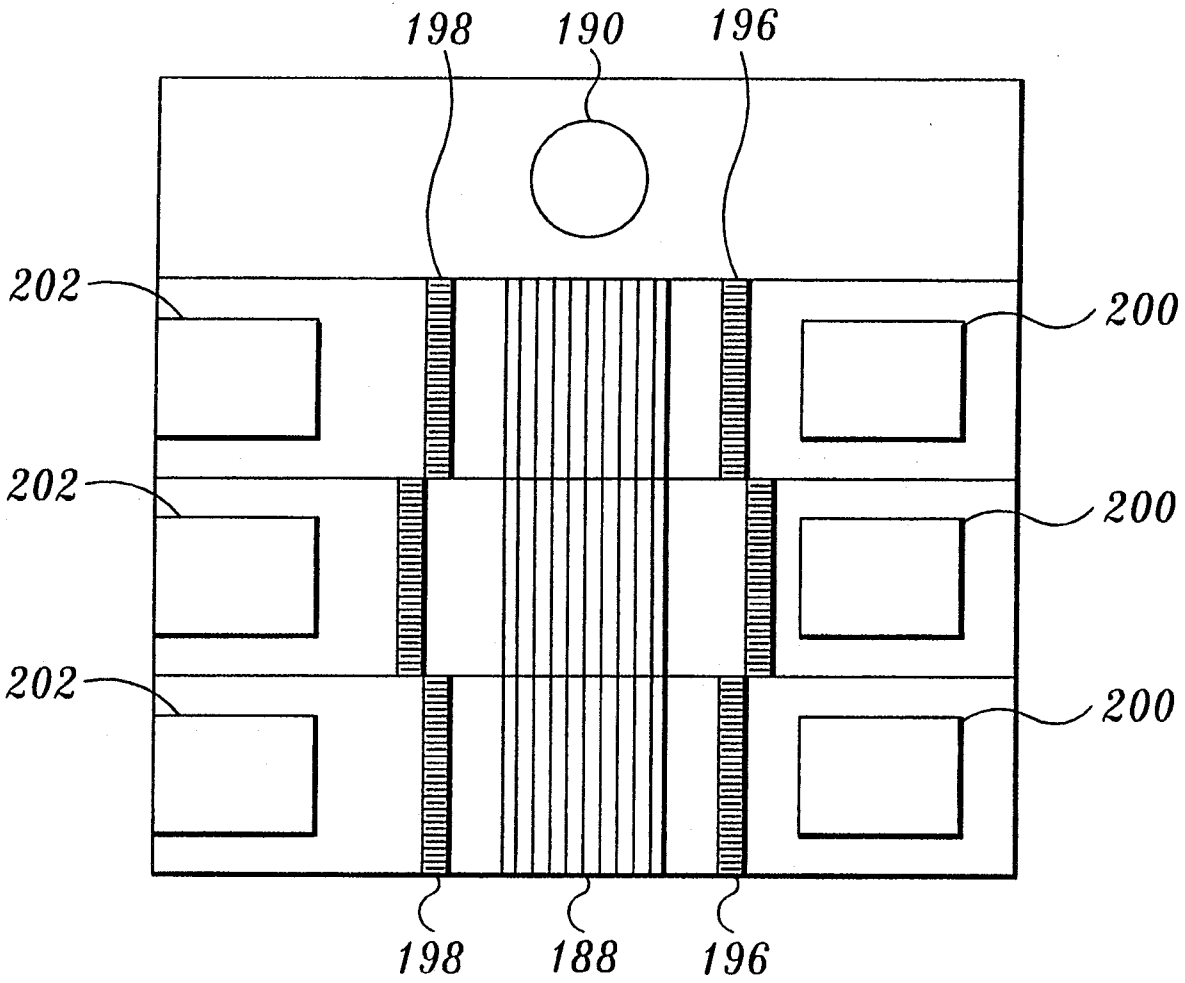
FIG. 14 is a schematic illustration of the air exchanger of FIG. 12.

Reviewing the representative construction of module 182 in greater detail, as shown in FIG. 14, a crossed damper 188 is included in a central exchange compartment 190. Air from a return vent 192 and external vent 194 is directed by damper 188 across either a supply coil 196 or exhaust coil 198. Supply and exhaust blowers 200 and 202 are then responsible for forcing the air to a first zone or the external environment through vents 204 or 206, respectively. As will be appreciated, the construction of the remaining modules is the same.

The single-stack exchanger 178 has a greater capacity due primarily to its addition of a separate exhaust blower for each module. In addition, this embodiment also has a relatively low cabinet profile.

Those skilled in the art will recognize that the embodiments of the invention disclosed herein are exemplary in nature and that various changes can be made therein without departing from the scope and the spirit of the invention. In this regard, a variety of additional components can be added to the system as desired. For example, the system can be modified to include or delete optional heat exchangers, heat sources, coils, filters, and sensors. Further, control of the system can be varied in numerous ways. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. An air exchanger, for controlling the flow of air between a supplied environment and an external environment, comprising:

housing means for defining an air exchange chamber, an external air path and exhaust air path between said air exchange chamber and the external environment, and a return air path and supply air path between said air exchange chamber and the supplied environment;

supply energy transfer means, at least partially positioned in said supply air path, for influencing the temperature of air flowing through said supply air path to the supplied environment;

exhaust energy transfer means, at least partially positioned in said exhaust air path, for influencing the temperature of air flowing through said exhaust air path to the external environment;

supply air blower means for inducing airflow through said supply air path;

exhaust air blower means for introducing airflow through said exhaust air path;

an airflow control damper, positioned in said air exchange chamber, having first, second, third, and fourth arms, the flow of air from said return air path and said external air path to said supply air path being controlled solely by cooperation between the first and second arms, the flow of air from said return air path and said external air path to said exhaust air path being controlled solely by cooperation between the third and fourth arms; and damper control means for controlling the operation of said first, second, third, and fourth damper arms.

2. The air exchanger of claim 1, wherein said first, second, third, and fourth damper arms each include a plurality of pivotable damper vanes for controlling the flow of air through said first, second, third, and fourth arms.

3. The air exchanger of claim 2, wherein said damper control means further comprises:

ventilation control means for producing an output indicative of a desired volume of air flowing in said supply air path and said exhaust air path; and damper actuator means for receiving said ventilation control output and controlling the position of said damper vanes in said damper arms in response thereto.

4. The air exchanger of claim 3, wherein said damper vanes in said first and third damper arms are pivotable by said damper actuator means to be substantially parallel to each other and whereins said damper plates in said second and fourth damper arms are similarly pivotable by said damper actuator means to be substantially parallel to each other.

5. The air exchanger of claim 4, further comprising supply air control means for producing a supply air temperature control output indicative of a desired temperature of air flowing in said supply air path, said supply energy transfer means being for receiving and responding to said supply air temperature control output by influencing the temperature of air flowing in said supply air path.

6. The air exchanger of claim 5, wherein said supply energy transfer means further comprises:

coil means for receiving a fluid and for transferring heat between said fluid and air flowing through said supply air path; and fluid supply means, coupled to said coil means, for supplying fluid to said coil means.

7. An air exchanger for controlling the flow of air between a supplied environment and an external environment, consisting of:

housing means for defining an air exchange chamber, an external air path and exhaust air path between said air exchange chamber and the external environment, and a return air path and supply air path between said air exchange chamber and the supplied environment;

supply energy transfer means, at least partially positioned in said supply air path, for influencing the temperature of air flowing through said supply air path to the supplied environment;

exhaust energy transfer means, at least partially positioned in said exhaust air path for influencing the temperature of air flowing through said exhaust air path to the external environment;

supply air blower means for inducing airflow through said supply air path;

exhaust air blower means for inducing airflow through said exhaust air path;

an airflow control damper, positioned in said air exchange chamber, having first, second, third, and fourth arms, the flow of air from said return air path and said external air path to said supply air path being controlled solely by cooperation between the first and second arms, the flow of air from said return air path and said external air path to said exhaust air path being controlled solely by cooperation between the third, and fourth arms; and damper control means for controlling the operation of said first, second, third, and fourth damper arms.

* * * * *

UNITED STATES PATENT AND TRADEMARK OFFICE

CERTIFICATE OF CORRECTION

PATENT NO. : 5,348,077

DATED : September 20, 1994

INVENTOR(S) : C.F. Hillman

It is certified that error appears in the above-indentified patent and that said Letters Patent is hereby corrected as shown below:

| COLUMN | LINE | |
|---|---|---|
| 2 | 55 | "Is" should read --is-- |
| 4 | 31 | "Is" should read --is-- |
| 7 | 68 | "conduit, .back" should read --conduit, back-- |
| 8 | 21 | "Is" should read --is-- |
| 11 | 43 | "Is" should read --is-- |
| 14 | 8 | "Input" should read --input-- |
| 14 | 22 | "Its" should read --its-- |
| 19 (Claim 1, | 51 Line 20) | "introducing" should read --inducing-- |

Signed and Sealed this

Thirty-first Day of January, 1995

*Attest:*

Bruce Lehman

BRUCE LEHMAN

*Attesting Officer*

*Commissioner of Patents and Trademarks*